United States Patent [19]

Burgio, Jr.

[11] Patent Number: 4,811,493

[45] Date of Patent: Mar. 14, 1989

[54] DRYER-COOLER APPARATUS

[76] Inventor: Joseph T. Burgio, Jr., 725 Jennings St., Bethlehem, Pa. 18017

[21] Appl. No.: 81,843

[22] Filed: Aug. 5, 1987

[51] Int. Cl.[4] ..... F26B 3/26

[52] U.S. Cl. ..... 34/4; 34/41; 34/66

[58] Field of Search ..... 34/1, 4, 41, 66, 39

[56] References Cited

U.S. PATENT DOCUMENTS

| | | | |
|---|---|---|---|
| 2,668,700 | 2/1954 | Zimmerman | 34/41 |
| 3,733,709 | 5/1973 | Bassemir et al. | 34/4 |
| 3,825,407 | 7/1974 | Fujite et al. | 34/39 X |
| 3,826,014 | 7/1974 | Helding | 34/41 X |
| 3,967,385 | 7/1976 | Culbertson | 34/4 |
| 4,135,098 | 1/1979 | Troue | 34/4 X |
| 4,143,278 | 3/1979 | Koch, II | 34/1 X |
| 4,408,400 | 10/1983 | Colapinto | 34/4 |
| 4,449,453 | 5/1984 | Staffer et al. | 34/41 X |

*Primary Examiner*—Steven E. Warner
*Attorney, Agent, or Firm*—Joseph J. O'Keefe

[57] ABSTRACT

An improved dryer-cooler apparatus cures or dries a heat sensitive coating on a moving substrate in a manner to minimize problems related to heating. The apparatus comprises a cooling plate, an end block at each end of the cooling plate and a plurality of heating lamps extending between the end blocks, above a reflective face of the cooling plate. The cooling plate has a plurality of cooling passages which extend from the top to bottom ends thereof, and each end block has a plurality of lamp openings and has a plurality of coolant passage openings that each aligns with a coolant passage of the cooling plate. The ends of each heating lamp are supported in an unencumbered manner in the lamp openings of the end blocks. Thus, the heating lamps and the cooling plate and end blocks can expand and contract without damage when cyclically heated and cooled during periodic operation of the dryer-cooler apparatus. Coolant from a refrigeration system is circulated in a serpentine manner through the cooling plate while the heat generated by the adjacent heating lamps is reflected downwardly from the cooling plate reflective surface. Thus, the cooling plate acts as a heat-sink to absorb unused energy from the lamps and to cool the space on the opposite side of the cooling plate from the heating lamps.

12 Claims, 3 Drawing Sheets

8
1
2
4
3
6
7
9
5
74
10
20'
21'
74'
A
71
80

71
73
65
60
50
10
66
74
30
20
66'
31

DRYER-COOLER APPARATUS

FIELD OF THE INVENTION

This invention relates to improved dryer-cooler apparatus and is particularly directed to apparatus using infra-red heating for curing or drying a heat sensitive coating on a moving substrate so as to minimize problems related to heating.

BACKGROUND OF THE INVENTION

Recent advances in printing press drying applications using infra-red equipment have led to higher powered systems. In many drying applications, for both ink and other heat sensitive coatings, press operations have increased to the extent that substrate speeds of 500 feet per minute are common. As a consequence, the surfaces of such substrates are irradiated or exposed to heat for only a very limited time. There has been a trend toward the use of higher specific output heating units. Lamps capable of up to 200 watts per inch of infra-red power are currently in use. Due to the physical limitations on space within most printing press housings, the drying apparatus must accomplish its purposes more rapidly than in the past and within the restricted available space. With the higher operating temperatures of the high powered lamps the resultant heat behind conventional heating units is easily 50 to 100 degrees Fahrenheit above ambient temperatures, which initiates a detrimental increase in heat in the vicinity of the drying units. As the heat accumulates around the dryers, the temperature rises in the final housing in which the drying equipment is located and backs up into the adjacent printing unit creating further problems. It is well known that changes of as little as 10° F. to 15° F. can significantly alter ink and coating viscosities, as well as affect water balance and alcohol content. The expansion and contraction of the dryer equipment leads to equipment failures. For example, many printing presses utilize chain driven continuous belts with grippers to feed the sheets by the dryers, and the spring loaded elements associated with such parts soften under the increasingly higher temperatures, creating further problems. Of course, when presses using infra-red drying apparatus are operated for long periods, e.g. three shifts per day, or during hot, high humidity conditions during the summer months the heating problems are compounded.

Currently presses with infra-red drying systems operate with higher powered lamps in one of several ways. Some presses are operated in the old manner without adequate cooling, and the equipment is shut down when higher temperatures create problems. More efficient presses have associated cooling systems that utilize either air or water cooling apparatus.

There has been a variety of prior art systems for dealing with the heat problems created by drying equipment. U.S. Pat. No. 3,825,407 to Y. Fujite et al. describes a reflector for reducing heat in a copying machine by the use of a reflector plate adjacent the heating elements. While the system employs no direct cooling of the reflector, loosely mounted brackets for the reflector permit thermal distortion to take place without damage to the reflector. U.S. Pat. No. 4,135,098 to H. Troue describes the use of a mercury vapor lamp with a reflector module to direct ultra-violet light to a coating on a moving substrate. The temperature of each reflector, which partially surrounds each lamp, is controlled by means of a water cooled heat sink spaced above the reflector so that only radiation heat transfer takes place between the reflector module surface and the heat sink. U.S. Pat. No. 4,143,278 to R. L. Koch, II, describes the use of a cooling pipe arrangement positioned between a substrate and downwardly open lamp assemblies, which have ultra-violet lamps for heating the substrate. In addition to the cooling provided by the pipe arrangement, ambient air is circulated to the dryer housing and is exhausted from the lower portion thereof. U.S. Pat. No. 4,408,400 to F. Colapinto, describes the use of a radiation type of heat exchanger which is positioned beneath the guide path of moving sheets to cool the unprinted underside of the passing sheets for the purpose of preventing any overheating.

The above mentioned prior art inventions have helped reduce some heating problems associated with specific drying apparatus. However, modern, multi-stage high speed presses which utilize infra-red heating lamps to dry coatings on moving substrates continue to be plagued with problems created by excessive detrimental heat build-up in the immediate vicinity of the heating lamps, in the housings where they are located, and in the adjacent press components.

OBJECTS OF THE INVENTION

Drying systems that make use of forced air circulation to cool both dryers and the environment within the housing of the final stage of a multi-unit press are favored by many manufacturers. The fans and blowers for such systems are not restricted in size as they are mounted outside the housing and they are easy to maintain and operate. However, forced air systems must operate at a restricted flow rate since an excess volume of air disturbs the flow current for which the equipment is designed for optimum coating drying conditions and also disrupts the smooth flat passage of the substrate as it passes the dryer. On the other hand, present water cooled systems are generally are restricted in size and structure by virtue of the limited space available within the final housing of multi-stage presses. As a consequence, many such systems are fabricated of lightweight welded cooling panels that sometimes rupture due to the thermocycling. This causes both physical damage to the equipment and water damage to the coated substrates. Also, the panels fail to provide adequate cooling for different operating conditions.

The object of the present invention is to provide an apparatus to be used with infra-red lamps which effectively reflects the radiant energy from the lamps to the coating on the passing substrate, while acting as a heat sink to reduce temperatures behind the apparatus to a reasonable level.

It is a further object of the invention to provide an apparatus which functions well with high powered lamps, permits thermal expansion and contraction without structural problems and is easy to maintain, particularly with respect to the replacement of the infra-red lamps.

SUMMARY OF THE INVENTION

The present invention overcomes the problems and disadvantages of the prior art apparatus by providing a compact, structurally sound, water-cooled apparatus for curing or drying heat sensitive coatings on substrates moving rapidly past the apparatus. More specifically, the apparatus comprises a cooling plate having a flat top-reflective surface and a plurality of internal passages for the circulation of liquid coolant. Mounted at opposite sides of the cooling plate are refractory insulating blocks which have a plurality of openings to support lamp ends and to permit the passage of coolant tubing to the plate. A plurality of high-powered lamps is mounted in parallel arrangement above the plate-reflective surface with the opposite ends of each lamp loosely supported in openings in the insulating end blocks. Leads from the ends of each lamp pass through the end block openings in which the lamp is supported and are interconnected to the leads of the ends of other lamps and to an appropriate source of power. In somewhat similar fashion, the coolant passages in the plate are interconnected by tubing for the circulation of coolant through the plate. The inlet tubing to the plate and discharge tubing from the plate are part of a closed circuit system joined to a refrigerating unit that controls the temperature of the dryer-cooler apparatus, regardless of the ambient temperature and the time of dryer operation.

By employing the apparatus of the present invention, the temperature within the housing in which the dryer is located is maintained at a reasonable level such that an associated printing press may be continuously operated, despite relatively high ambient temperatures, to effectively dry the coatings on substrates rapidly passing adjacent such apparatus without contributing to problems with the associated equipment.

BRIEF DESCRIPTION OF THE DRAWINGS

The nature of the invention will be more clearly understood by reference to the following description, the appended claims and the several views illustrated in the accompanying drawings.

DETAILED DESCRIPTION OF THE PREFERRED EMBODIMENTS

Figure 1:
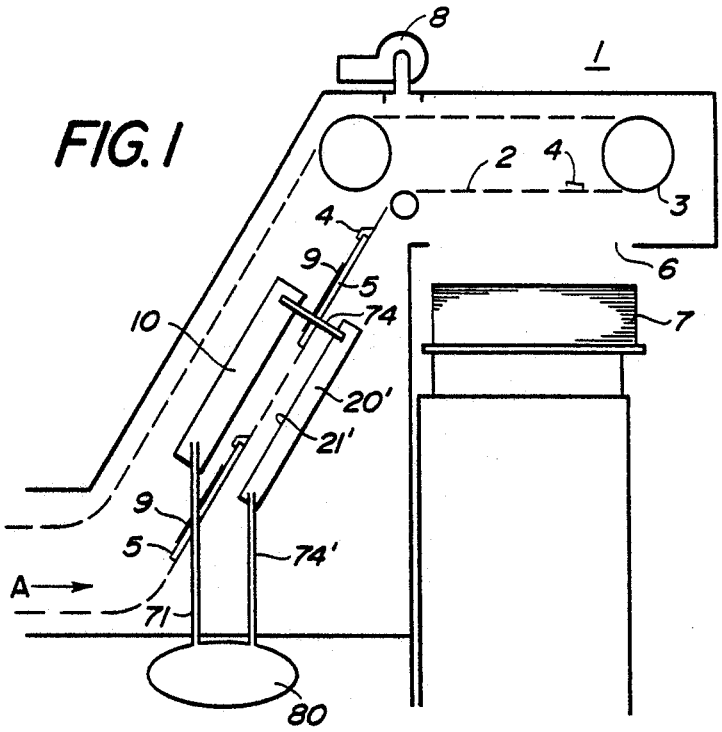
FIG. 1 is a schematic cross sectional view of the last stand of a multi-stand, multi-color sheet fed printing press through which a rapidly moving coated substrate is passed for the purpose of drying the substrate coating by means of the apparatus of this invention.

For purposes of this invention, it will be described for use with a multi-color, multi-stand printing press capable of handling individual printed sheets having a width of approximately 40 inches and traveling at a speed of approximately 300 feet per minute. Referring to FIG. 1, there is shown a final housing 1 of such press in which is locate feed chain 2 traveling in the direction of arrow A and driven by sprocket 3. A plurality of releasable clamps 4 connected to chain 2 engages the leading edges of sheets 5, which have on their upper surfaces a thin ink coating 9 and convey the sheets along a fixed feed path controlled by the feed chain 2. Adjacent the end of housing 1 the clamps 4 release and the individual sheets 5 drop through housing opening 6 onto the top of a stack of sheets 7 from where they are subsequently moved to a desired location. As sheets 5 travel along the feed path they pass dryer-cooler assembly 10. Exhaust blower 8 continually removes hot moist air from the interior of housing 1.

Figure 2:
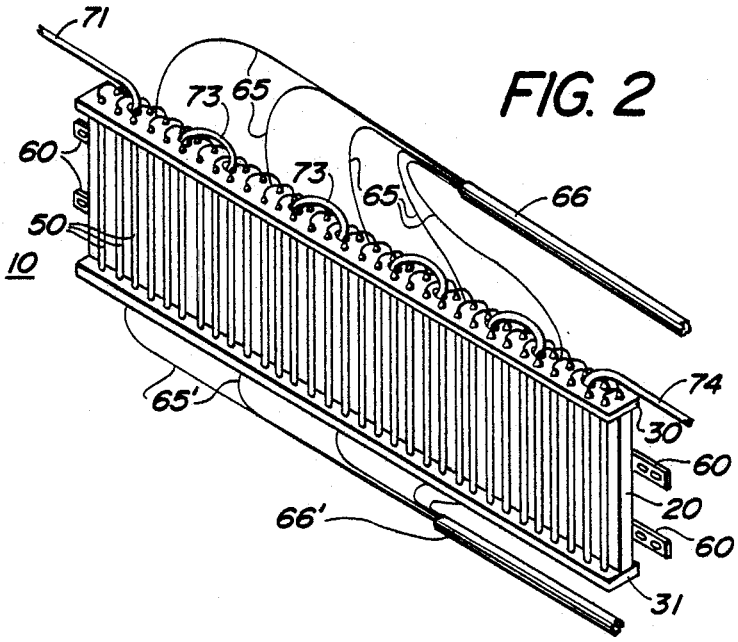
FIG. 2 is an isometric view of an embodiment of the dryer-cooler assembly of this invention.
Figure 3:
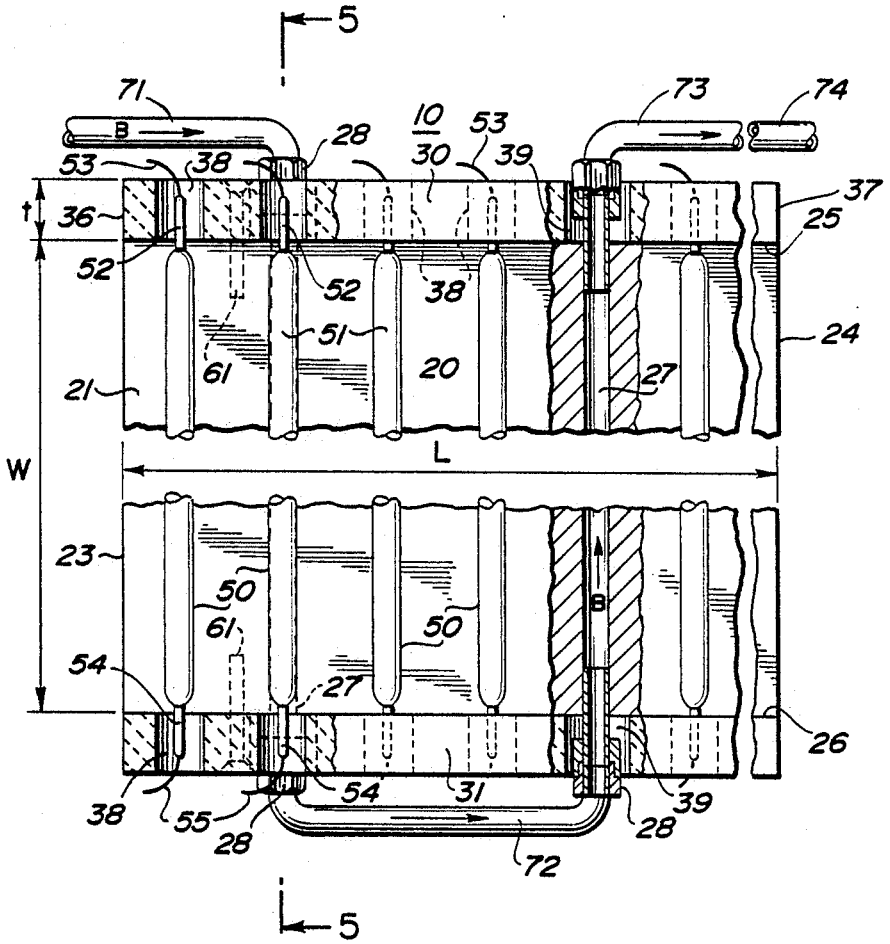
FIG. 3 is a partial plan sectional view illustrating details of the dryer invention.

As best shown in FIGS. 2 and 3, dryer-cooler assembly 10 comprises cooling plate 20, top end block 30 and bottom end block 31, tubular lamps 50 and support arms 60 that connect with appropriate structural members, not shown, within housing 1.

Figure 5:
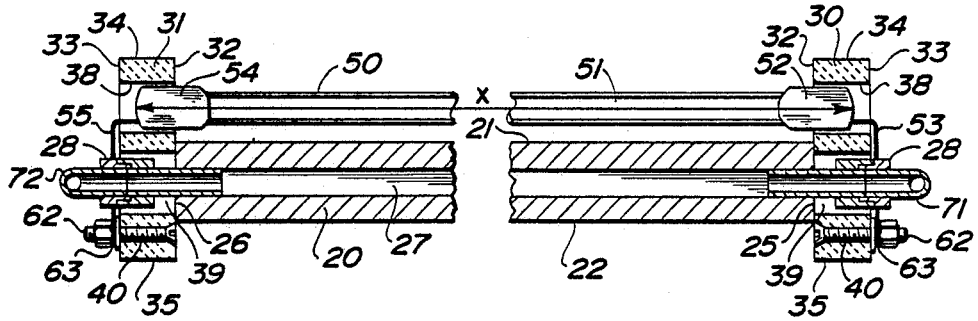
FIG. 5 is an enlarged sectional view taken along the line 5—5 of FIG. 3.

As shown in FIGS. 3 and 5, cooling plate 20 has a length L, a width W, and a thickness T. Cooling plate 20 has a front reflective surface 21, back surface 22, sides 23 and 24, top end 25 and bottom end 26. Extending through plate 21 from top end 25 to bottom end 26 is a plurality of coolant passages 27.

Figure 4:
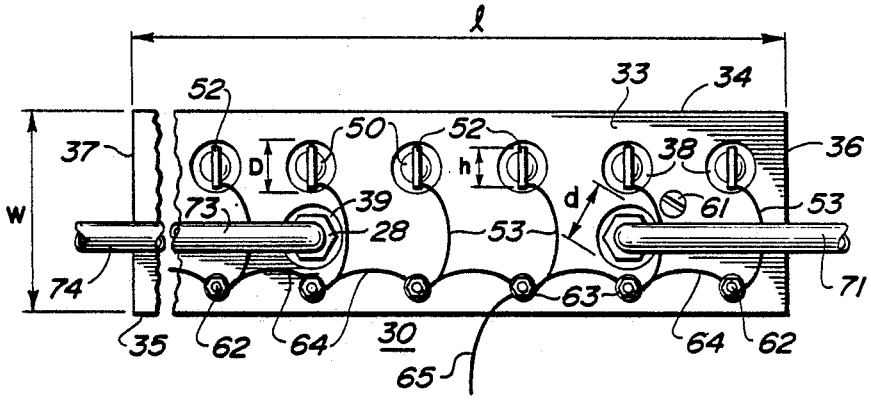
FIG. 4 is an end view of the arrangement shown in FIG. 3.

As shown in FIG. 3, top end block 30 and bottom end block 31 are fastened to cooling plate 20 by means of countersunk machine screws 61, in a manner well known to those skilled in the art. As shown in FIGS. 3, 4 and 5, blocks 30 and 31 have inside faces 32, outside faces 33, tops 34, bottoms 35 and ends 36 and 37. Block 30 has a length l, width w and thickness t. A plurality of openings, including lamp openings 38, water conduit openings 39 and connector stud openings 40, extends through blocks 30 and 31 from inside face 32 to outside face 33. A plurality of spaced lamp openings 38 is spaced from top 34 of blocks 30 and 31 and has a diameter D. A plurality of spaced water conduit openings 39, each which has a diameter d and aligns with water conduit passages 27 of cooling plate 20, is spaced intermediate top 34 and bottom 35 of top end blocks 30 and 31. A plurality of connector stud openings 40 is spaced from the bottom 35 of blocks 30 and 31, and countersunk connector studs 62 extend through openings 40. Connector stud nuts 63 are threaded on studs 62. The number of connector stud openings 40 and studs 62 are equal to the number of lamp openings 38.

As best shown in FIGS. 4 and 5, a plurality of lamps 50 is loosely mounted in dryer-cooler assembly 10, spaced above cooler reflector surface 21. Each lamp 50 has a tubular body portion 51, flattened metal top end portion 52 from which lead wire 53 extends, and flattened metal bottom end portion 54 from which lead wire 55 extends. Lamp end portions 52 and 54 each have a height h, as shown in FIG. 4, slightly less than diameter D of lamp openings 38 of end blocks 30 and 31. Each lamp 50, including end portions 52 and 54, has a length x somewhat longer than the width W of cooling plate 20. Thus, the metal end portions 52 and 54 of each lamp 50 extend into lamp openings 38 of end blocks 30 and 31, respectively, and body 51 of each lamp 50 is positioned above reflector surface 21 of cooling plate 20.

FIG. 4 illustrates the manner in which dryer assembly 10 is wired. Top lead wire 53 from each lamp top metal end portion 52 is connected to the adjacent connector stud 62 associated with each such lamp, and a jumper wire 64 extends from each connector stud 62 to the next such adjacent stud and so on for the number of lamps 50 and associated studs 62 for top end block 30 and bottom end block 31 of dryer assembly 10. A main lead wire 65 is also connected to one of several connector studs, and similar main lead wires are connected to other such studs in a manner known to those skilled in the art. The lead wires 65 for top end block 30 are formed into a top cable 66, as shown in FIG. 2, which connects with a central control panel and power source, not shown. The wires joining each connector stud 62 are held in place by stud nut 63. The bottom lead wire 55 from each lamp bottom metal end portion 54 is connected to a connector stud 62 associated therewith in bottom end block 31, and is wired, not shown, in a manner similar to that of end block 30, including comparable bottom main lead wires 65' to bottom cable 66'.

As shown in FIGS. 3 and 5, extending outwardly from the top and bottom ends of each coolant passage 27 of cooling plate 20 are a series of connector fittings 28. Inlet tube 71 at one end thereof connects with a refrigeration system 80, shown in FIG. 1, and at the other end thereof with the first connecting fitting 28, which is at the top end 25 of cooling plate 20 and connects with the first coolant passage 27. At the bottom end of the first coolant passage 27, connection fitting 28 connects with one end of bottom cross-over tube 72, the other end of which connects with connector fitting 28 of the next adjacent or second coolant passage 27. At the top end of second coolant passage 27, connector fitting 28 connects with one end of the top cross-over tube 73 the other end of which connects with a connector fitting 28, not shown, of the next adjacent or third coolant passage 27, etc., for the length of cooling plate 20. As shown in FIG. 2, the last coolant passage 27 of cooling plate 20 connects with coolant discharge tube 74 and thence to refrigeration system 80.

In a second embodiment of this invention, dryer-cooler assembly 10 includes a second cooling plate 20', as shown in FIG. 1. Cooling plate 20' is positioned in housing 1 on the underside of feed chain 2, spaced therefrom and opposite dryer-cooler assembly 10. Cooling plate 20' is identical to cooling plate 20 of dryer-cooler assembly 10, except that its reflector surface 21' faces toward dryer-cooler assembly 10. Coolant discharge tube 74 from cooler plate 20 connects with the coolant inlet end of cooling plate 20' and the discharge end of cooling plate 20' connects through coolant discharge tube 74' to refrigeration system 80.

In the preferred embodiments of the invention described above and used on a multi-stand printing press capable of handling individual sheets having a width of approximately 40 inches, cooling plates 20 and 20' are made of machined aluminum plate approximately 40 inches long, 10.5 inches wide and 0.75 inches thick. Reflector surfaces 21 and 21' are highly polished to reflect about 90% of short wave energy, have a flat smooth surface and may be coated with a reflective coating, such as lithium oxide or gold. A plurality of spaced passages 27 having a diameter of approximately 0.32 inches is drilled through cooler plates 20 and 20' for the passage of coolant. The passages are spaced to provide for reasonably uniform cooling throughout the plates and in the 40 inches long plate there are 10 transverse passages 27.

End blocks 30 and 31 are fired ceramic for insulating purposes and are approximately 40 inches long, 2.25 inches wide and 0.75 inches thick. Lamp openings 38, of which there are 30, are approximately 0.625 inches in diameter and equally spaced along the block length, except for half spaces at either ends of the blocks. Coolant passage openings 39, of which there are 10, equal to the number of coolant passages in the cooling plate, are approximately 0.688 inches in diameter, and align with the coolant passages 27 in cooling plate 20. However, openings 39 are larger in diameter than the diameter of passage 27 to permit clearance for easy manipulation of coolant passage connection fittings 28.

Lamps 50 are of the T-3 short wave type, such as manufactured by Sylvania. These types of lamps are preferred for an in-press situation for the following reasons:

(a) They provide greater percentage absorption/-power input to the substrate. In addition, the total heat obtainable is significantly greater since a short wave filament reaches approximately 2200° C., while a medium or long wave device cannot exceed 800° C.

(b) They have low thermal inertia. A T-3 lamp reaches full output in less than 2 seconds and more importantly dissipates heat within 2 seconds when power is removed.

(c) They have a power to size advantage. With an average length of approximately $11\frac{1}{2}$ inches, width of approximately $\frac{1}{8}$ inches and power of approximately 1000 watts, the short wave lamp provides superior power to size ratio, which allows a smaller dryer to be used in a given installation.

Although the preferred embodiments were described with reference to a press capable of handling individual printed sheets having a width of approximately 40 inches, the apparatus of this invention may be designed for installation in presses handling narrower or wider sheets. Furthermore, while dryer-cooler assembly 10 was described as having component lengths of the approximate width of such printed sheets, it should be recognized that the dryer-cooler assembly 10 can be made in modular form such that the block ends 30 and 31 and/or cooling plate 20 may be made of different lengths and widths described above, assembled in abutting relationship and fastened to support arms 60. The wiring and cooling tubes are connected in a manner similar to that described above.

The preferred embodiments of cooling plates 20 and 20', as described, are made of aluminum with a thickness T of approximately 0.75 inches. Other superior heat-sink materials, such as copper, may be used for such cooling plates and the thickness may be varied, depending upon the heat generated by lamps 50 and the degree of cooling to be accomplished. In similar fashion, the number of plate coolant passages, their diameter and the coolant flow rate may also be varied to accomplish the desired degree of cooling. The use of the term "plate" as used herein includes, for the purposes of this invention, a plate, solid casting or extrusion. The coolant passes through cooling plates 20 and 20' in a serpentine manner. That is, it passes downwardly through the first coolant passage 39 and out the bottom thereof, continues through first bottom crossover tube 72 and passes upwardly through the second coolant passage 27, continues through the first top coolant passage 73, as shown by arrow B in FIG. 3, etc. for the length of the cooling plates 20 and 20' and then passes from the plates through discharge tubes 74 and 74' respectively. The preferred cooling described for the cooling plates 20 and 20', as used in conjunction with refrigeration system 80, is a closed circuit system that is designed with thermostatically controlled valves, well known to those skilled in the art, to maintain the temperature of coolant passing through the plates at any desired level.

The width w and thickness t of the end blocks 30 and 31 may also be varied. The simple means, i.e. machine screw 61, by which end blocks 30 and 31 are fastened to the cooling plate 20 enables the plate to expand and contract freely without setting up damaging stresses in either the cooling plate or the end blocks. In similar fashion the lamps 50 may also expand and contract freely since each lamp top and bottom metal end portions 52 and 54, respectively, has a height h less than the diameter D of the block lamp openings 38 in which such end portions are supported. The only restraint on a lamp is that provided by top and bottom end portion lead wires 53 and 55, respectively, which are flexible and loose, except where they are connected to studs 62.

The manner in which the ends of lamps 50 are mounted permits their easy replacement. A lamp may be changed by merely disconnecting top and bottom lead wires 53 and 55 from their adjacent connector studs 62 and withdrawing the lamp through one of its lamp openings 38 in either end block 30 or 31. A new lamp is installed in the reverse manner.

The improved dryer-cooler apparatus of this invention permits expansion and contraction, without damage of lamps 50, end blocks 30 and 31 and cooling plate 20, when cyclically heated and cooled during use of the lamps in day-to-day press operations. Cooling plate 21 acts as a heat sink to absorb from lamps 50 as much unused energy generated as possible and to lower the operating temperature in the vicinity of the cooling plate, particularly on the back or opposite side thereof from the lamps.

The invention described above is particularly applicable for retrofitting in existing presses where severe space limitations exist. The invention is a compact, highly effective dryer-cooler apparatus which employs a heat-sink reflector intrinsically more substantial than prior art-conventional aluminum or stainless sheet reflectors. Furthermore, the directed cooling circuit significantly reduces temperature zones across the length and width of the reflector, thus reducing any chance for thermally induced physical shifts in the panel and expansion-contraction stresses that lead to damage to the apparatus. The use of the dryer-cooler apparatus of the invention in high-speed presses permits press operation at lower housing temperatures than is experienced with use of other dryer-cooler apparatus.

I claim:

1. Dryer-cooler apparatus for curing a heat sensitive coating on a substrate passing adjacent said apparatus, comprising:

(A) a cooling plate comprising:
- (1) a first flat surface adjacent said substrate,
- (2) a second surface,
- (3) first and second ends, and
- (4) a plurality of coolant passages extending through said cooling plate from said first end to said second end, including:
  - (i) a first coolant passage, and
  - (ii) a last coolant passage;

(B) an end block abutting said cooling plate first end and having an opening extending therethrough;

(C) lamp means extending adjacent said cooling plate first flat surface and having an end portion with a height less than the diameter of said end block opening and extending into said opening;

whereby coolant is circulated through said first coolant passage and out of said last coolant passage to cool said cooling plate and said lamp means end portion is free to move unencumbered within said end block opening without causing damage to said end block and said lamp as said lamp expands and contracts when cyclically heated and cooled during periodic operations of said apparatus.

2. Dryer-cooler apparatus of claim 1 wherein plate means further comprises:

(A) a plurality of intermediate coolant passages extending through said cooling plate from said first end to said second end;

(B) a first cross-over conduit connecting said first coolant passage with one of said intermediate coolant passages; and (C) a second cross-over conduit connecting one of said intermediate coolant passages with said last coolant passage.

3. Dryer-cooler apparatus for curing a heat sensitive coating on a substrate passing adjacent said apparatus, comprising:

(A) a cooling plate comprising:
- (1) a first flat surface spaced from said substrate,
- (2) a second surface on the opposite side of said cooling plate from said first flat surface,
- (3) cooling plate first and second ends, and
- (4) first and last coolant passages extending through said cooling plate from said first end to said second end;

(B) a first end block abutting said cooling plate first end and having:
- (1) a plurality of lamp openings extending through said first end block, and
- (2) a plurality of coolant conduit openings extending through said first end block;

(C) a second end block abutting said cooling plate second end and having:
- (1) a plurality of lamp openings extending through said second end block, and
- (2) a plurality of cooling conduit openings extending through said second end block;

(D) a plurality of lamp means extending adjacent said cooling plate first flat surface and between said first and second end blocks, each said lamp means having:
- (1) a first end portion extending into one of said lamp openings of said first end block, and
- (2) a second lamp end portion extending into one of said lamp openings of said second end block;

(E) inlet means passing through one of said coolant conduit openings of one of said end blocks and connecting with said first coolant passage of said cooling plate; and (F) discharge means passing through one of said coolant conduit openings of one of said end blocks and connecting with said last coolant passage of said coolant plate whereby heat from said plurality of lamp means is reflected by said first flat surface of said cooling plate to said coating of said substrate to cure said coating, and coolant is circulated through said conduit inlet means and said first coolant passage and out of said last conduit passage and said conduit discharge means of said cooling plate to cool said plate and the area extending outwardly from said cooling plate second surface.

4. The dryer-cooler apparatus of claim 3 wherein said cooling plate further comprises:

(A) a plurality of intermediate coolant passages extending through said cooling plate from said first end to said second end;

(B) a first cross-over conduit having a first end connecting with said first coolant passage of said cooling plate, extending through one of said lamp openings of one of said end blocks and through the next adjacent of said lamp openings of said same end block and connecting with the first of said intermediate coolant passages of said cooling plate; and (C) a second cross-over conduit having a first end connecting with the last of said intermediate coolant passages of said cooling plate, extending through one of said lamp openings of one of said end blocks and through the next adjacent of said lamp openings of said same end block and connecting with said last coolant passage of said cooling plate.

5. The apparatus of claim 3 wherein said first flat surface of said cooling plate has a reflecting finish.

6. The dryer-cooler apparatus of claim 3 wherein said first and second end blocks are made of insulating ceramic material to withstand the heat from said lamp means.

7. The dryer-cooler apparatus of claim 3 wherein said lamp openings extending through said first and second end blocks have a diameter greater than the height of said first and second end portions of each said lamp whereby said first end portion of each said lamp is free to move unencumbered within one of said lamp openings of said first end block and said second end portion of each said lamp is free to move unencumbered within one of said lamp openings of said second end block without causing damage to said blocks and said lamp as said lamp expands and contracts when cyclically heated and cooled during periodic operations of said apparatus.

8. The dryer-cooler apparatus of claim 3 wherein the number of lamp openings to each of said first and second end blocks exceeds the number of coolant passages in said cooling plate.

9. The dryer-cooler apparatus of claim 3 wherein said first end block has a plurality of connecting means and a lead wire from said first end portion of each said lamp means connects with an adjacent connecting stud of said first end block and said second end block has a plurality of connecting means and a lead wire from said second end portion of each said lamp means connects with an adjacent connecting means of said second end block, and the adjacent connecting means of said first and said second end blocks are connected by jumper means.

10. The dryer-cooler apparatus of claim 3 wherein said first end block is fastened to said cooling plate first end by connecting means and said second end block is fastened to said cooling plate second end by connecting means whereby said cooling plate and said first and second end blocks may expand without damage when cyclically heated and cooled during periodic operations of said lamp means of said apparatus.

11. The dryer-cooler apparatus of claim 3 wherein said cooling plate is made of aluminum.

12. The dryer-cooler apparatus of claim 3 where said apparatus further comprises a second cooling plate spaced from said first cooling plate on the opposite side of said passing substrate.

* * * * *

UNITED STATES PATENT AND TRADEMARK OFFICE

CERTIFICATE OF CORRECTION

PATENT NO. : 4,811,493

DATED : March 14, 1989

INVENTOR(S) : Joseph T. Burgio, Jr.

It is certified that error appears in the above-identified patent and that said Letters Patent is hereby corrected as shown below:

Col. 2, line 39, the word "are" before "restricted" should be deleted.

Col. 3, line 59, the word "locate" should read --located--.

Col. 6, line 15, "approximately 1/8 inches" should read --approximately 3/8 inches--.

Signed and Sealed this

Seventeenth Day of October, 1989

*Attest:*

DONALD J. QUIGG

*Attesting Officer*

*Commissioner of Patents and Trademarks*